United States Patent [19]

Christensen

[11] Patent Number: 5,054,137

[45] Date of Patent: Oct. 8, 1991

[54] APPARATUS FOR MANEUVERING A PHYSICALLY IMPAIRED INDIVIDUAL

[76] Inventor: Richard H. Christensen, P.O. Box 84, Greenwood, Calif. 95635

[21] Appl. No.: 662,951

[22] Filed: Mar. 1, 1991

[51] Int. Cl.[5] ..... A61G 7/10

[52] U.S. Cl. ..... 5/81 R

[58] Field of Search ..... 5/81 R, 81 B, 86, 507, 5/508, 503

[56] References Cited

U.S. PATENT DOCUMENTS

| | | | |
|---|---|---|---|
| 2,757,388 | 8/1956 | Chisholm | 5/507 |
| 2,975,435 | 3/1961 | Forrest | 5/81 R |
| 3,911,509 | 10/1975 | Fleckenstein | 5/81 R |
| 4,279,043 | 7/1981 | Saunders | 5/81 R |
| 4,934,003 | 6/1990 | Hayakawa et al. | 5/81 R |

*Primary Examiner*—Alexander Grosz

*Attorney, Agent, or Firm*—Thomas R. Lampe

[57] ABSTRACT

Apparatus for maneuvering a physically impaired individual including a base member, a platform rotatably mounted relative to the base member for supporting the individual, a stabilizer projecting upwardly from the platform to be manually grasped by the individual, and a lock arrangement for selectively locking the platform and the base member against relative rotatable movement.

6 Claims, 3 Drawing Sheets

APPARATUS FOR MANEUVERING A PHYSICALLY IMPAIRED INDIVIDUAL

TECHNICAL FIELD

This invention relates to apparatus for maneuvering a physically impaired individual. More particularly, the apparatus is utilized to support and rotate the individual to facilitate his or her transfer from one location to another, e.g. from a bed to a wheel chair.

BACKGROUND ART

Transfer of a physically impaired or disabled individual from one location to another can be a formidable task, especially when only one other person is available to assist in such transfer. This latter situation, of course, is often the case when the physically impaired individual is at home or in other non-institutional environments.

Typical transfers which must be carried out every day with regard to physically impaired individuals include, for example, transfers to and from a bed and transfers to and from a wheel chair.

Hoists of various types have been devised to maneuver patients from one location to another. However, such devices are characterized by their relative complexity and high expense. Investment in and use of hoist arrangements is not normally justified unless an individual is severely physically impaired to the point of being virtually immobile and incapable of standing.

DISCLOSURE OF INVENTION

The apparatus of the present invention is of relatively simple, low-cost construction, yet it is highly effective as an aid for maneuvering the physically impaired. Utilizing the apparatus a single person can readily maneuver the physically handicapped or impaired individual without undue exertion or strain.

The apparatus includes a base member and platform means having an upwardly disposed platform surface. The platform means is mounted for rotatable movement relative to the base member and at least partially supports the weight of an individual standing on the platform surface. When the platform means is rotated the individual standing on the platform surface is also rotated to a preselected orientation. For example, the individual may step onto the platform means from a bed. He or she is then rotated to another orientation, for example, to a position or location enabling the individual to be seated in a wheel chair.

Stabilizer means projects upwardly from the platform surface to be manually grasped by the individual standing on the platform surface. The stabilizer means includes an elongated element affixed to the platform means at a generally centrally disposed location on the platform surface whereby the individual's feet may be positioned on opposed sides of the elongated element. Handle means is affixed to the elongated element at a predetermined location spaced from the platform surface for grasping by the individual.

The elongated element is canted relative to the platform surface whereby the predetermined location is offset relative to the generally centrally disposed location and the upper body of the individual is accommodated by the cant of the elongated element.

Other features, advantages, and objects of the present invention will become apparent with reference to the following description and accompanying drawings.

BEST MODE FOR CARRYING OUT THE INVENTION

Figure 1:
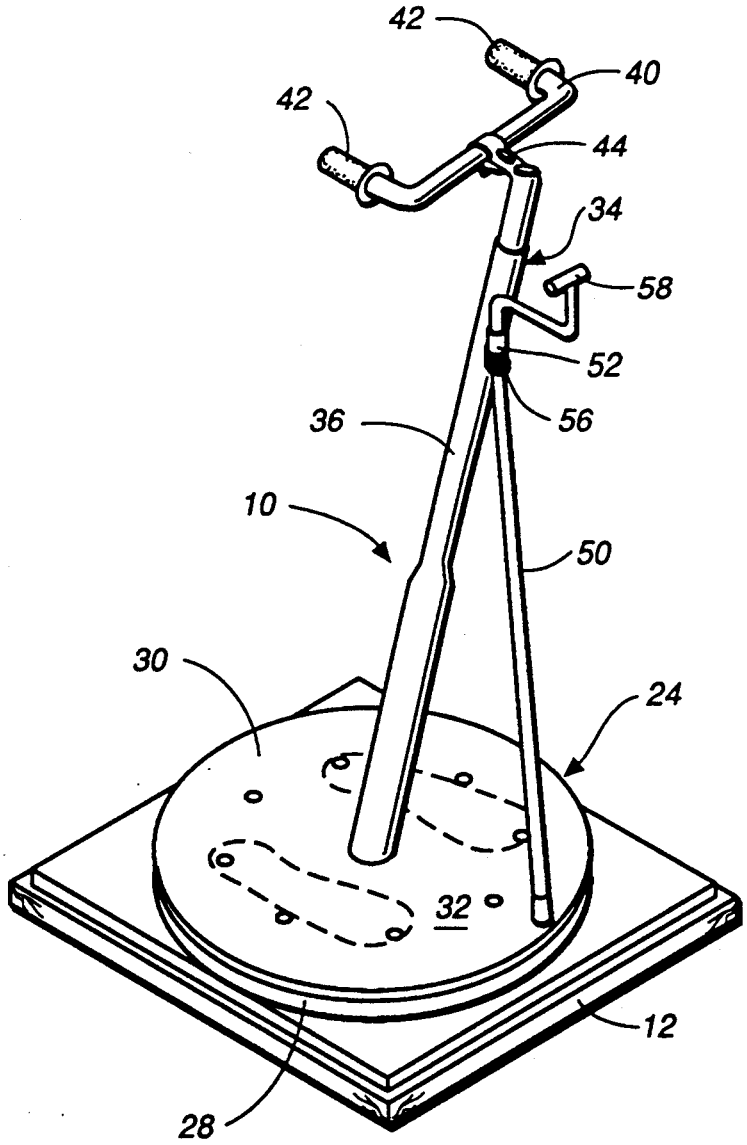
FIG. 1 is a perspective view of apparatus constructed in accordance with the teachings of the present invention.
Figure 2:
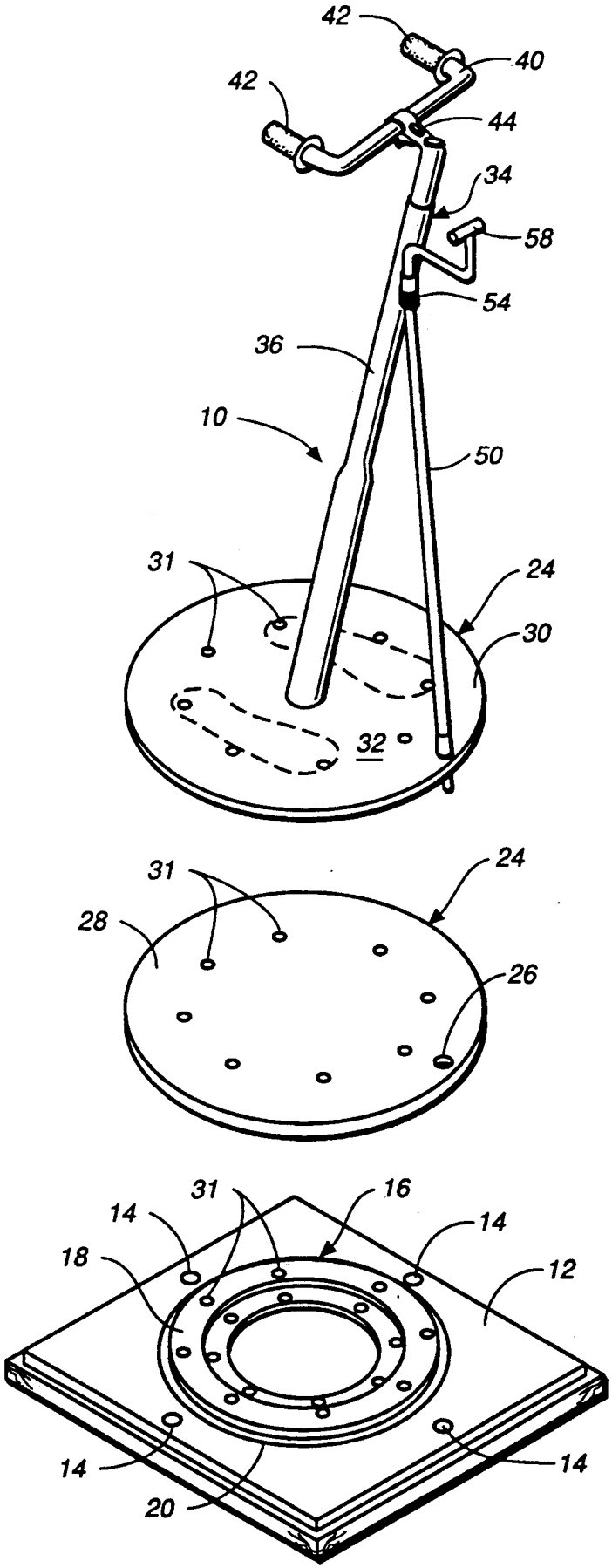
FIG. 2 is an exploded, perspective view of the apparatus.

Referring now to the drawings, apparatus constructed in accordance with the teachings of the present invention is generally designated by reference numeral 10. Apparatus 10 includes a base member 12 constructed of wood, metal, plastic, or any other suitable material. The base member defines a plurality of apertures or holes 14 spaced from one another. In the particular arrangement illustrated the apertures 14 are four in number and essentially equidistant from one another. It should be appreciated, however, that a greater or lesser number of apertures 14 may be employed in keeping with the spirit of the present invention.

A circular-shaped bearing 16 of any suitable conventional construction is located at the top of the base member. Bearing 16 has two relatively rotatable components, an upper bearing component 18 and a lower bearing component 20. Lower bearing component 20 is affixed by suitable fasteners, such as screws, to base member 12. The upper bearing component 18 is freely rotatable relative to the lower bearing component and the base member. Ball or roller bearings (not shown) are preferably disposed between the bearing components 18, 20 to assure such freedom of rotation.

Secured to upper bearing component 18, as by bolts, screws or the like, is a platform 24. Platform 24 is of rigid construction, being formed of any suitable material such as wood, plastic or metal. Platform 24 defines an aperture 26 so positioned that it is placed in registry seriatim with the base member apertures 14 when the platform is rotated relative to the base member on bearing 16. In the arrangement illustrated, platform 24 includes a lower platform element 28 and an upper platform element 30 secured together by any suitable expedient. For example, upper bearing component 18 and lower and upper platform elements 28, 30 may all have a plurality of holes 31 which are disposed in alignment to accommodate bolts, screws or other fasteners (not shown) to secure items 18, 28, 30 together. However, it is to be understood that the platform 24 may be of integral, single-element construction. In either event, the platform 24 has an upwardly disposed platform surface 32.

Attached to platform 24 and projecting upwardly from platform surface 32 is stabilizer means 34 including elongated element 36. The elongated element 36, as illustrated, is of tubular construction, the lower end of the elongated element being secured to the platform by any suitable expedient. For example, if the platform at the upper surface 32 thereof is steel and the elongated element 36 is also steel, these two components may be welded together.

Stabilizer means 34 also includes a handle 40 secured to the elongated element 36. Handle 40 is forked in the manner of a bicycle handle and includes two grips 42. As in a bicycle handle, handle 40 may include means 44 for adjusting the angular disposition of the grips.

It is to be noted that elongated element 36 is canted relative to the platform surface 32 whereby the location of attachment of the handle 40 to the elongated element 36 is offset relative to the generally centrally disposed location of attachment of the elongated element 36 to the platform 24.

Lock means is provided for selectively locking the platform means and the base member against relative rotatable movement. More particularly, the lock means includes a shaft 50. Shaft 50 is slidably disposed in a bracket 52 affixed to elongated element 36. The lower or distal end of shaft 50 projects into aperture 26 in platform 24. A coil compression spring 54 is disposed about a portion of shaft 50 between bracket 52 and an enlargement 56 affixed to the shaft. The spring 54 continually urges the shaft 50 in a downward direction.

Shaft 50 is of such a length that the lower or distal end thereof will pass completely through aperture 26 when the shaft is at its lowermost position and into any one of the apertures 14 in base member 12 which happens to be in registry or alignment with the aperture 26. The shaft therefore, when in such lowermost position, locks platform 24 against rotational movement relative to the base member. When, however, the shaft 50 is pulled upwardly against the urging of spring 54 the distal end of the shaft is withdrawn from the aperture 14 and the platform 24 may be rotated relative to the base member upon application of a slight force to effect such rotation.

The shaft 50 is bent above the bracket 52 in the manner illustrated and a manually graspable element or handle 58 is affixed to the shaft. Such an arrangement facilitates manual manipulation of the shaft.

The operation of the apparatus 10 is straightforward. First, the apparatus is brought to a position closely adjacent to the physical impaired individual. The apparatus is situated with the handle grips 42 pointing in the direction of the individual. The individual places his or her feet on the platform 24 in the positions designated by the dash lines in the drawing. That is, one foot is disposed at one side of the elongated element 36 and another foot is disposed on the other side thereof.

The individual now grasps grips 42 and assumes a standing position on the platform. This may be accomplished if need be with the assistance of another person. All of the foregoing steps are carried out with the shaft 50 in its lowermost position locking platform 24 against rotational movement. It will be noted that the cant of the elongated element 36 is away from the patient so that his or her upper body is accommodated by the cant and he or she can stand straight with weight applied at a generally central platform location.

Figure 3B:
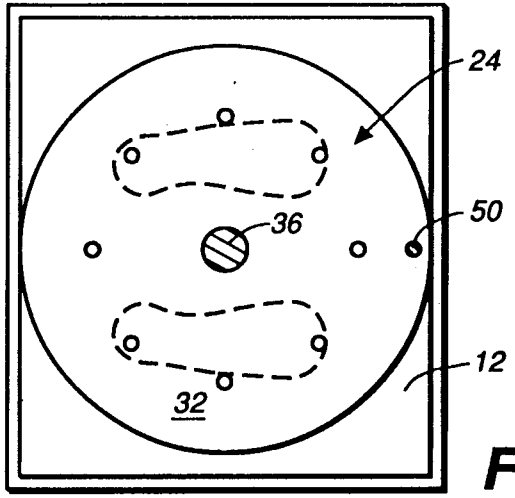
FIGS. 3A–3D are diagrammatic plan views illustrating alternative positions assumable by the platform of the apparatus.
Figure 3D:
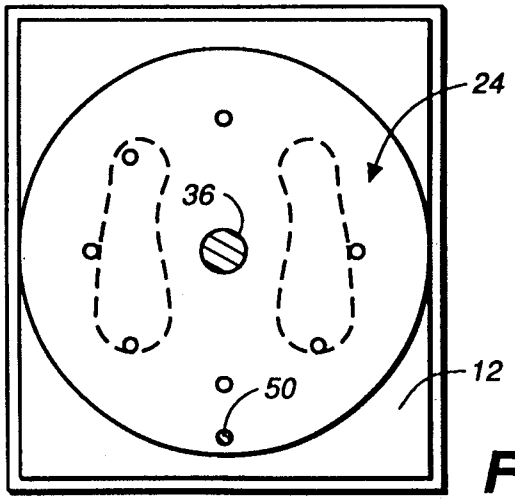
Figure 3A:
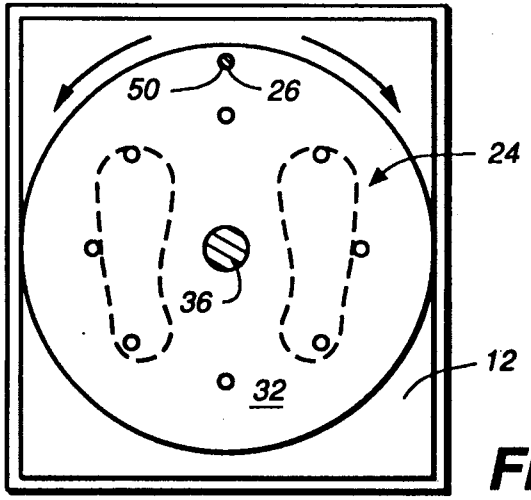
Figure 3C:
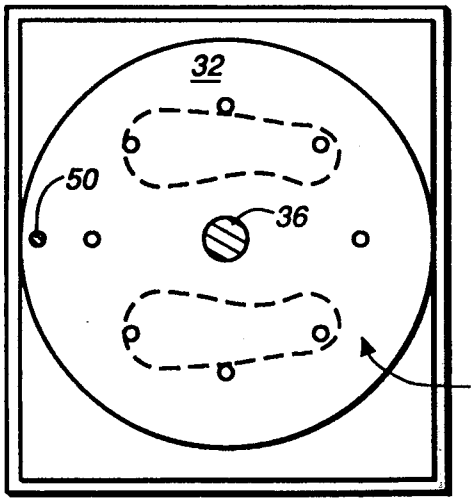

The next phase of the operation of apparatus 10 is to rotate the individual standing on the platform so that he or she is properly positioned to be received at another location. For example, that other location might be a wheel chair positioned adjacent to a bed from which the individual has arisen. The attending person assisting the physically impaired individual rotates the platform 24 to correctly orient the individual with respect to the wheel chair or other location. This can only be accomplished by withdrawing shaft 50 from the base member aperture 14 within which it resides to prevent movement. The impaired individual or the attending person may accomplish this simply by drawing on handle 58 and drawing shaft 50 upwardly against the urging of spring 54. After rotation is accomplished the shaft is allowed to re-enter another of the apertures 14 corresponding to the desired orientation of the platform. FIGS. 3A–3D illustrate the four alternate positions assumable by the platform 24.

I claim:

1. Apparatus for maneuvering a physically impaired individual, said apparatus comprising, in combination:

a base member defining a plurality of spaced base member apertures;

platform means having an upwardly disposed platform surface and mounted for rotatable movement relative to said base member for at least partially supporting the weight of an individual standing on said platform surface and for selectively rotating said individual, said platform means defining a platform means aperture being placed in registry seriatim with said base member apertures upon rotation of said platform means relative to said base member;

stabilizer means projecting upwardly from said platform surface to be manually grasped by the individual standing on said platform surface; and lock means for selectively locking said platform means and said base member against relative rotatable movement, said lock means being selectively positionable in said platform means aperture and a base member aperture in registry therewith to lock said platform means against rotational movement relative to said base member and including a shaft mounted for relative movement on said stabilizer means and having a distal end positionable in said base member and platform means apertures.

2. The apparatus according to claim 1 additionally comprising bearing means disposed between said base member and said platform means to facilitate relative rotatable movement therebetween when said lock means is not locking said platform means and said base member against relative rotatable movement.

3. The apparatus according to claim 1 wherein said stabilizer means includes an elongated element affixed to the platform means at a generally centrally disposed location on said platform surface whereby said individual's feet may be positioned on opposed sides of said elongated element, and handle means affixed to the elongated element at a predetermined location spaced from said platform surface for grasping by the individual.

4. The apparatus according to claim 3 wherein said elongated element is canted relative to said platform surface whereby said predetermined location is offset relative to said generally centrally disposed location and the upper body of said individual is accommodated by the cant of said elongated element.

5. The apparatus according to claim 1 additionally comprising biasing means operatively associated with said lock means shaft and said stabilizer means to bias said lock means shaft relative to said stabilizer means in the direction of said platform means.

6. The apparatus according to claim 1 wherein said lock means additionally includes a manually graspable element affixed to said shaft for facilitating manual movement of said shaft.

* * * * *